US005483940A

United States Patent [19]

Namba et al.

[11] Patent Number: 5,483,940

[45] Date of Patent: Jan. 16, 1996

[54] APPARATUS AND A METHOD FOR CONTROLLING FUEL SUPPLY TO ENGINE

[75] Inventors: Toshio Namba; Masanobu Osaki; Junichi Furuya, all of Atsugi, Japan

[73] Assignee: Unisia Jecs Corporation, Atsugi, Japan

[21] Appl. No.: 256,084

[22] PCT Filed: Nov. 9, 1993

[86] PCT No.: PCT/JP93/01627

§ 371 Date: Jun. 29, 1994

§ 102(e) Date: Jun. 29, 1994

[30] Foreign Application Priority Data

Nov. 9, 1992 [JP] Japan ..... 4-298796

[51] Int. Cl.[6] ..... F02M 37/04

[52] U.S. Cl. ..... 123/497; 123/357

[58] Field of Search ..... 123/497, 456, 123/357, 468, 469

[56] References Cited

U.S. PATENT DOCUMENTS

| | | | |
|---|---|---|---|
| 3,699,931 | 10/1972 | Cinquegrani | 123/497 |
| 3,822,677 | 7/1974 | Reddy | 123/497 |
| 4,248,194 | 2/1981 | Prutchas | 123/357 |
| 4,756,291 | 7/1988 | Cummins | 123/497 |
| 5,207,199 | 5/1993 | Sekiguchi | 123/357 |
| 5,293,853 | 3/1994 | Berger | 123/357 |
| 5,339,781 | 8/1994 | Osawa | 123/357 |
| 5,355,859 | 10/1994 | Weber | 123/456 |

FOREIGN PATENT DOCUMENTS

| | | | |
|---|---|---|---|
| 8204097 | 11/1982 | European Pat. Off. | 123/497 |
| 57-108427 | 7/1982 | Japan . | |
| 0108427 | 7/1982 | Japan | 123/497 |
| 59-150972 | 8/1984 | Japan . | |
| 60-128952 | 7/1985 | Japan . | |
| 60-212634 | 10/1985 | Japan . | |
| 61-55347 | 3/1986 | Japan . | |
| 62-101875 | 5/1987 | Japan . | |
| 2-90355 | 7/1990 | Japan . | |

*Primary Examiner*—Carl S. Miller
*Attorney, Agent, or Firm*—Foley & Lardner

[57] ABSTRACT

A basic discharge QK Of a fuel pump is determined based on an engine load and an engine rotational speed, and further a correction amount QG for correcting the basic discharge QK based on comparison of an actual fuel pressure PT with a target pressure Po is learnt for every driving conditions. Then, the basic discharge QK is corrected with the correction amount QG, whereas in a transient condition, the basic discharge QK is corrected with a transient correction amount QT set on the basis of a variation rate ΔPT Of the fuel pressure PT. Thus, it is possible to ensure that an amount of fuel required by an engine is surely supplied without excess fuel supply from the fuel pump.

12 Claims, 5 Drawing Sheets

APPARATUS AND A METHOD FOR CONTROLLING FUEL SUPPLY TO ENGINE

TECHNICAL FIELD

The present invention relates to an apparatus and a method for controlling fuel supply to an engine, and more particularly to a technique for controlling the operation of a fuel pump for force-feeding fuel to the engine, in accordance with an amount of fuel required by the engine.

BACKGROUND ART

The electronically controlled fuel injection system has conventionally controlled an amount of fuel to be supplied to an engine by controlling valve opening time of a fuel injection valve.

In such a conventional fuel injection system, it is impossible to inject a constant amount of fuel in accordance with the valve opening time, unless a differential pressure is kept to be constant between the pressure of fuel to be supplied to the fuel injection valve and the intake pressure in the vicinity of an injection hole of the fuel injection valve.

Accordingly, there has conventionally been provided a pressure regulator for controlling the pressure of fuel to be supplied to a fuel injection valve from a fuel pump, and to a reference pressure chamber of the pressure regulator has been introduced the inlet negative pressure from the downstream of a throttle valve. If a differential pressure between the pressure in the reference pressure chamber and the pressure of fuel supplied from the fuel pump exceeds a predetermined value, a return passage is forced to open for returning fuel to the fuel pump to thereby keep the differential pressure to be constant (See Japanese Unexamined Patent Publication No. 60-212634).

In such an apparatus as above mentioned in which the pressure of fuel to be supplied to a fuel injection valve is controlled by adjusting an amount of fuel which is returned by the pressure regulator, the fuel pump is controlled to discharge a slight larger amount of fuel than required for maintaining the aforementioned differential pressure to be constant even if an amount of fuel required by an engine increase. Therefore, a slight amount of fuel required by an engine has resulted that much of fuel is returned back to a fuel tank as return fuel.

The return fuel brought back to the fuel tank from the pressure regulator is warmed up by heat generated by the engine. Accordingly, the temperature of fuel contained in the fuel tank is increased by the warmed return fuel, and hence there are generated fuel vapors in the fuel tank. Thus, it has been desired to reduce an amount of return fuel as much as possible.

Thus, it has been suggested to control discharge of a fuel pump in accordance with an amount of fuel required by an engine. However, in this suggestion, it has been necessary to control the fuel pump so that the pump discharges a little larger amount of fuel than required, so as to disregard the dispersion and variation in discharge of a fuel pump, with the result of generation of return fuel.

Another system has been proposed for avoiding the generation of return fuel. In this system , there is provided a sensor for detecting the pressure of fuel present in a fuel supply passage, and the discharge of a fuel pump is controlled in accordance with the fuel pressure detected by the sensor.

However, in such a system as above mentioned in which the detected fuel pressure is fed back to control discharge of a fuel pump, for instance, during transition period in which a required fuel amount is incrementally changed, the discharge of the fuel pump is controlled to increase after the fuel pressure has been decreased as the required fuel amount is incrementally changed. This brings the result that the fuel pressure decreases due to response delay in control and also due to supply delay of fuel, and hence an amount of fuel required by an engine may not be supplied quite precisely during transient driving.

The invention aims to overcome the aforementioned problems, and thus it is an object of the present invention to provide a system in which it is possible to prevent generation of return fuel causing the temperature rise in a fuel tank, and also possible to securely force-feed a required amount of fuel even if discharge of a fuel pump is varied due to the variation and/or degradation of the fuel pump.

Another object of the present invention is to make it possible to accomplish a correction control with high accuracy in order to compensate for the variation in discharge of the fuel pump generated due to the variation and/or degradation of the fuel pump.

A further object of the present invention is to make it possible to secure the follow up to the fuel pressure during transient driving, while preventing generation of the return fuel.

DISCLOSURE OF THE INVENTION

In order to overcome the aforementioned problems, the present invention is constructed so that a basic control value for a fuel pump is set in accordance with an engine driving condition, the pressure of fuel force-fed from the fuel pump is detected, a correction value is learned for every driving conditions in order to correct the basic control value in accordance with comparison of the detected fuel pressure with a target pressure, and the fuel pump is controlled to drive in accordance with a final control value obtained by correcting the basic control value with the correction value.

According to such a construction, even if the correlation between the control value and the discharge or fuel pressure of the fuel pump is varied due to the variation and/or degradation of individual fuel pumps, the control value is corrected to thereby obtain a target pressure. Thus, it is possible to supply an optimum amount of fuel through the fuel pump, while preventing excessive fuel supply.

In another aspect, the invention is constructed so that a variation rate in an amount of fuel required by the engine is detected, and then the basic control value is corrected in accordance with the variation rate, and thus the fuel pump is controlled to drive in accordance with the thus corrected basic control value.

According to this construction, even when the amount of fuel required by the engine is varied, and hence response delay may occur if the fuel pump is controlled to drive in accordance with the basic control value, it is possible to avoid the response delay by the correction made in accordance with the variation rate. Thus, it is possible to secure the optimum amount of fuel even when the amount of fuel required by an engine is varied, while preventing excessive fuel supply in steady driving condition.

It is preferable to use the engine load and the rotational speed of engine as an engine driving condition for setting the basic control value.

Namely, since the required amount of fuel per a unit rotation can be determined based on the engine load, it is possible to assume the amount of fuel required by the engine per a unit period of time based on the engine load and the rotational speed of engine.

It is preferable to detect one of variations in the pressure of fuel force-fed from the fuel pump, in an amount of intake air supplied into the engine, and in basic injection pulse width of a fuel injection valve calculated in accordance with an amount of intake air supplied to a cylinder, as a parameter representing the variation rate of the amount of fuel required by the engine.

Namely, when the fuel pressure is varied in a great degree, it is possible to assume that the response delay is increased accordingly if the fuel pump is controlled only in accordance with the basic control value. In addition, both the variations in the intake air amount to be supplied to the engine and in basic injection pulse width correspond to the variation in the amount of fuel required by the engine. Thus it is possible to make a correction in accordance with the required fuel amount by setting a transient correction value according to the parameter.

It is preferable to learn the correction value in accordance with comparison of the pressure of fuel force-fed from the fuel pump with the target pressure under the condition that the engine is in steady driving operation.

It is possible to detect an error of the basic control value with high accuracy by permitting to learn the correction value only when the engine is in steady driving condition.

When the correction value is learnt in accordance with comparison of the pressure of fuel force-fed from the fuel pump with the target pressure, it is preferable to newly calculate a correction value based on the detected pressure, the target pressure and the basic control value at the time, and then renew stored data using a weighted mean value of the newly calculated correction value and the previous correction value as a correction value for the driving condition.

By using the weighted mean value of the previous learnt value and the newly learnt value, it is possible to avoid falsely learning due to an unexpected variation in pressure and setting a correction value quite differently from a required level.

BEST MODE FOR CARRYING OUT THE INVENTION

Hereinbelow will be explained an embodiment in accordance with the present invention.

Figure 3:
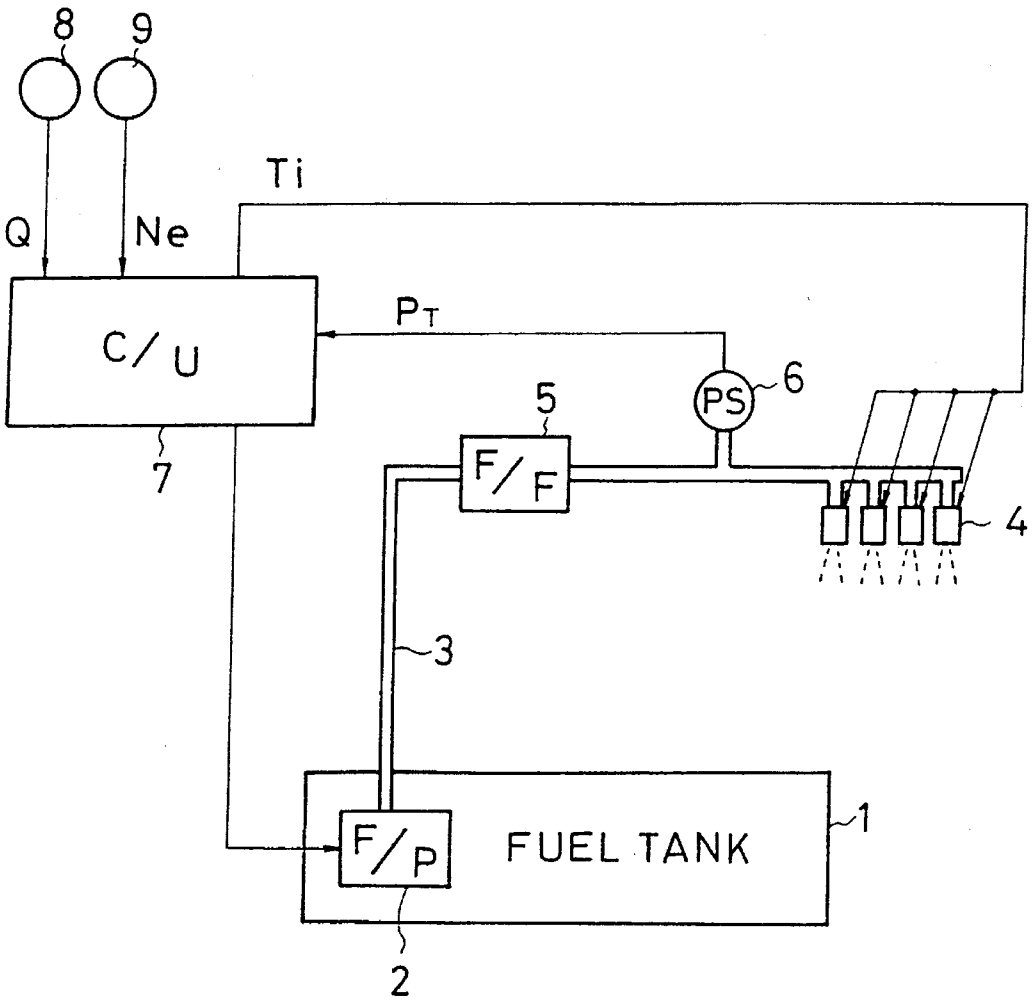
FIG. 3 is a schematic system diagram illustrating an embodiment in accordance with the present invention.

In FIG. 3 illustrating an embodiment in accordance with the present invention, fuel contained in a fuel tank 1 is sucked by a fuel pump 2, and then discharged therefrom to be force-fed to a plurality of fuel injection valves 4 through a fuel supply passage 3.

The fuel injection valves 4 are of electromagnetic type fuel injection valves which are made open when an electrical current is applied to a solenoid, while closed when an electrical current is not applied to a solenoid. The fuel injection valves 4 are controlled to intermittently open in accordance with drive pulse signals of a predetermined pulse width Ti (a valve opening time) which is transmitted from a control unit 7 to be described later and corresponds to an amount of fuel required by an engine, and thus inject fuel into an intake air passage disposed downstream of a throttle valve of the engine (not illustrated).

In the fuel supply passage 3 is disposed a fuel filter 5 and serving as a fuel pressure detecting means a fuel pressure sensor 6 for detecting fuel pressure PT in the vicinity of the fuel injection valves 4. The fuel pressure PT detected by the fuel pressure sensor 6 is transmitted to the control unit 7 which controls the operation of the fuel pump 2.

Into the control unit 7 are transmitted a detecting signal from the fuel pressure sensor 6, an intake air flow detecting signal Q from an air flow meter 8, and a rotational speed signal Ne from a crank angle sensor 9.

The control unit 7 having therein a microcomputer calculates a basic injection pulse width Tp (or a basic valve opening time) corresponding to an amount of fuel required by the engine, based on the intake air flow Q and the rotational speed Ne, and also sets various correction coefficients COEF in accordance with data such as a temperature Tw of cooling water and the like. Then, the control unit 7 corrects the basic injection pulse width Tp with the correction coefficients COEF to thereby set a final injection pulse width Ti.

The control unit 7 outputs a drive pulse signal having the aforementioned injection pulse width Ti to the fuel injection valves at a predetermined timing to thereby intermittently supply fuel corresponding to the required amount to the engine in accordance with a valve opening time.

In order to control the fuel amount injected from the fuel injection valves 4 in accordance with the valve opening time, it is necessary to control the fuel pressure PT SO as to be coincident with a target pressure (namely, a fuel pressure at which a differential pressure between an intake negative pressure of the engine and the fuel pressure is constant) corresponding to the driving condition (the intake negative pressure of the engine). To this end, the control unit 7 determines a required discharge (a control value) of the fuel pump 2 as shown in the flow chart in FIG. 4, to thereby control a voltage (or ON/OFF control duty) to be applied to the fuel pump 2 in accordance with the thus determined discharge.

Figure 1:
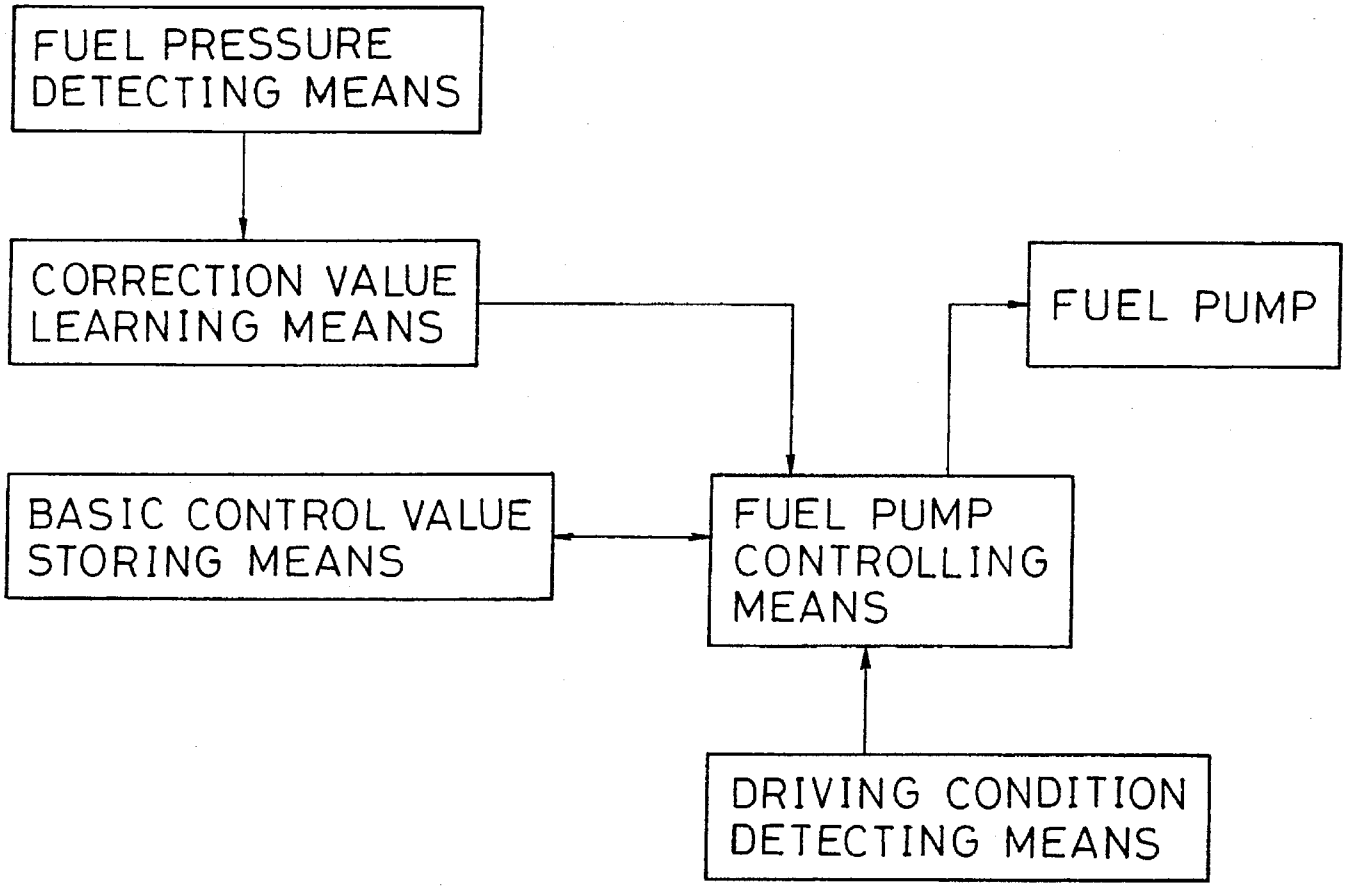
FIG. 1 is a block diagram showing basic elements for constituting the present invention as recited in claim 1.
Figure 2:
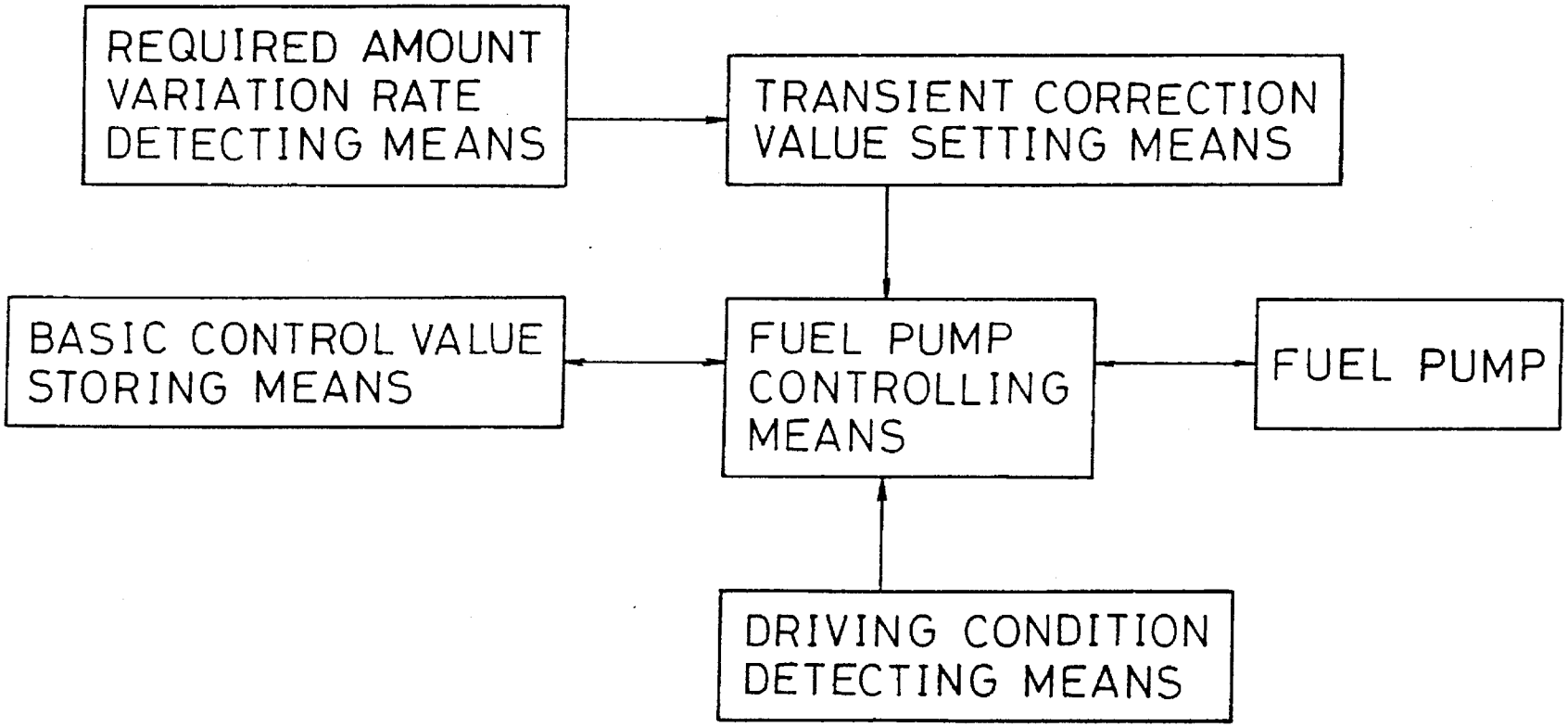
FIG. 2 is a block diagram showing basic elements for constituting the present invention as recited in claim 2.
Figure 4:
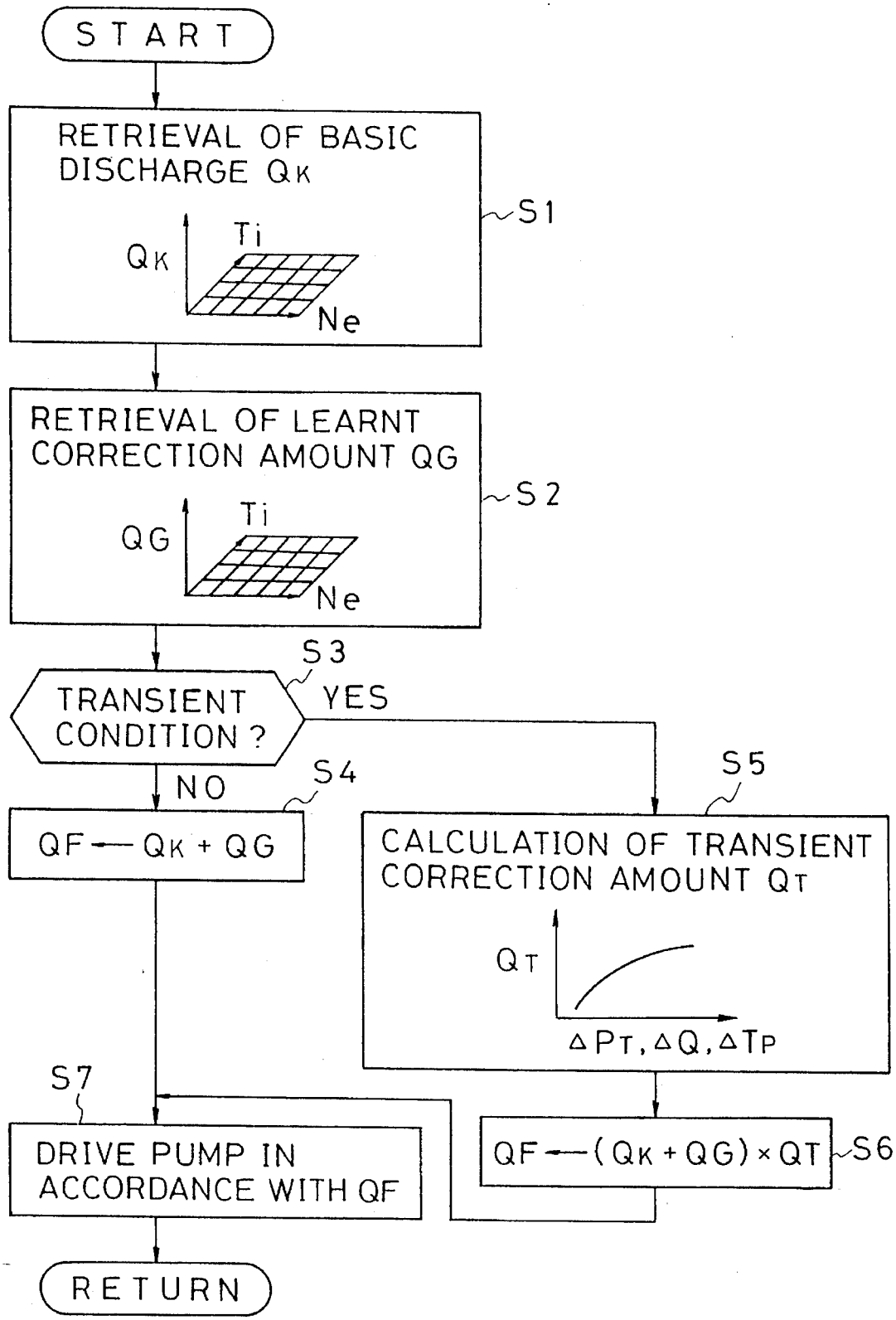
FIG. 4 is a flow chart showing how a fuel pump is controlled to drive in the embodiment.

It should be noted in the embodiment that the control unit 7 has functions of basic control value storing means, correction value learning means and fuel pump control means as recited in claim 1 (See FIG. 1), and also has functions of basic control value storing means, required amount variation rate detecting means, transient correction value setting means and fuel pump control means as recited in claim 2 (See FIG. 2), as shown in the flow chart in FIG. 4.

It also should be noted that driving condition detecting means as recited in claims 1 and 2 (See FIGS. 1 and 2) are embodied as the air flow meter 8 and the crank angle sensor 9 respectively.

In the flow chart in FIG. 4, a basic discharge QK corresponding to the engine driving condition at the present time is retrieved in step 1 with reference to a map storing therein a basic discharge QK (a basic control value) required by the fuel pump 2 during steady driving for each of a plurality of driving areas divided in dependence on the injection pulse width Ti ( a value corresponding to the engine load) and the engine rotational speed Ne.

The basic discharge QK means a discharge by which the fuel pressure PT can be arranged to be coincident with a target pressure corresponding to the driving condition (an intake negative pressure of the engine) on the assumption that there is no variation or degradation of the fuel pump 2. The basic discharge QK is determined in advance by experiments, and is stored in the map.

In step 2, if a desired discharge cannot be obtained due to the variation and/or degradation of the fuel pump 2, a learnt correction amount QG (a learnt correction value) learnt for compensating for excess and shortage of the discharge is retrieved. The learnt correction amount QG is stored so that it can be reloaded in the map in dependence on the injection pulse width Ti and the rotational speed Ne, similarly to the basic discharge QK. The learnt correction amount QG corresponding to the driving condition at the present time can be retrieved by referring to the map.

How the learnt correction amount QG is set by learning will be explained later.

In step 3, it is judged as to whether or not the driving condition is a transient condition in which the amount of fuel required by the engine varies, based on the variations, for example, in the fuel pressure PT, the intake air flow Q, and the basic injection pulse width Tp.

If the judgment indicates that the driving condition is not a transient condition, a final discharge QF (←QK+QG) is calculated in step 4 based on the basic discharge QK and the learnt correction amount QG.

Then, control proceeds from step 4 to step 7, the discharge QF (the final control value) is converted to a control output such as a voltage to be applied to the fuel pump 2. The fuel pump 2 receives the thus converted control output, and is controlled to drive in accordance with the output.

On the other hand, if the judgment in step 3 indicates that the driving condition is a transient condition, control proceeds to step 5 wherein a transient correction amount QT (a transient correction value) for compensating for a response delay generated due to a fuel feeding time during transition period is set on the basis of a variation rate (a transient variation rate) of parameters correlating to engine requirements such as the fuel pressure PT, the intake air flow Q and the basic injection pulse width Tp.

It is desirable to provide in advance a map storing transient correction amounts QT corresponding to the variation rates ΔPT, AQ and ΔTp of the fuel pressure PT, the intake air flow Q and the basic injection pulse width Tp respectively, and thus to make it possible to set the transient correction amount QT by referring to the map.

In step 6, the final discharge QF (←(QK+QG)×QT)is calculated on the basis of the basic discharge QK, the learnt correction amount QG and the transient correction amount QT.

In accordance with the foregoing embodiment, the basic discharge QK is stored in advance based on the injection pulse width Ti and the engine rotational speed Ne to thereby ensure that the discharge corresponding to the engine driving condition at the time can be obtained without a response delay from a viewing point of control.

The discharge QF determined as QF (←QK+QG) is able to maintain the desired fuel pressure PT during steady driving condition in which the amount of fuel required by the engine is approximately constant. However, when the required fuel amount changes to increase, for instance, the fuel pressure PT is reduced due to a feed delay of fuel even if the discharge is controlled to correspond to the increase of the required fuel amount.

Thus, the discharge QF is corrected in the transient condition in accordance with the transient variation rate of the fuel amount required by the engine, to thereby make it possible to correct the response delay.

Hereinbelow will be explained how the learnt correction amount QG is controlled to be set by learning with reference to the flow chart shown in FIG. 5. It should be noted that the function of the control unit 7 shown in the flow chart in FIG. 5 corresponds to correction value learning means as recited in claim 1.

Figure 5:
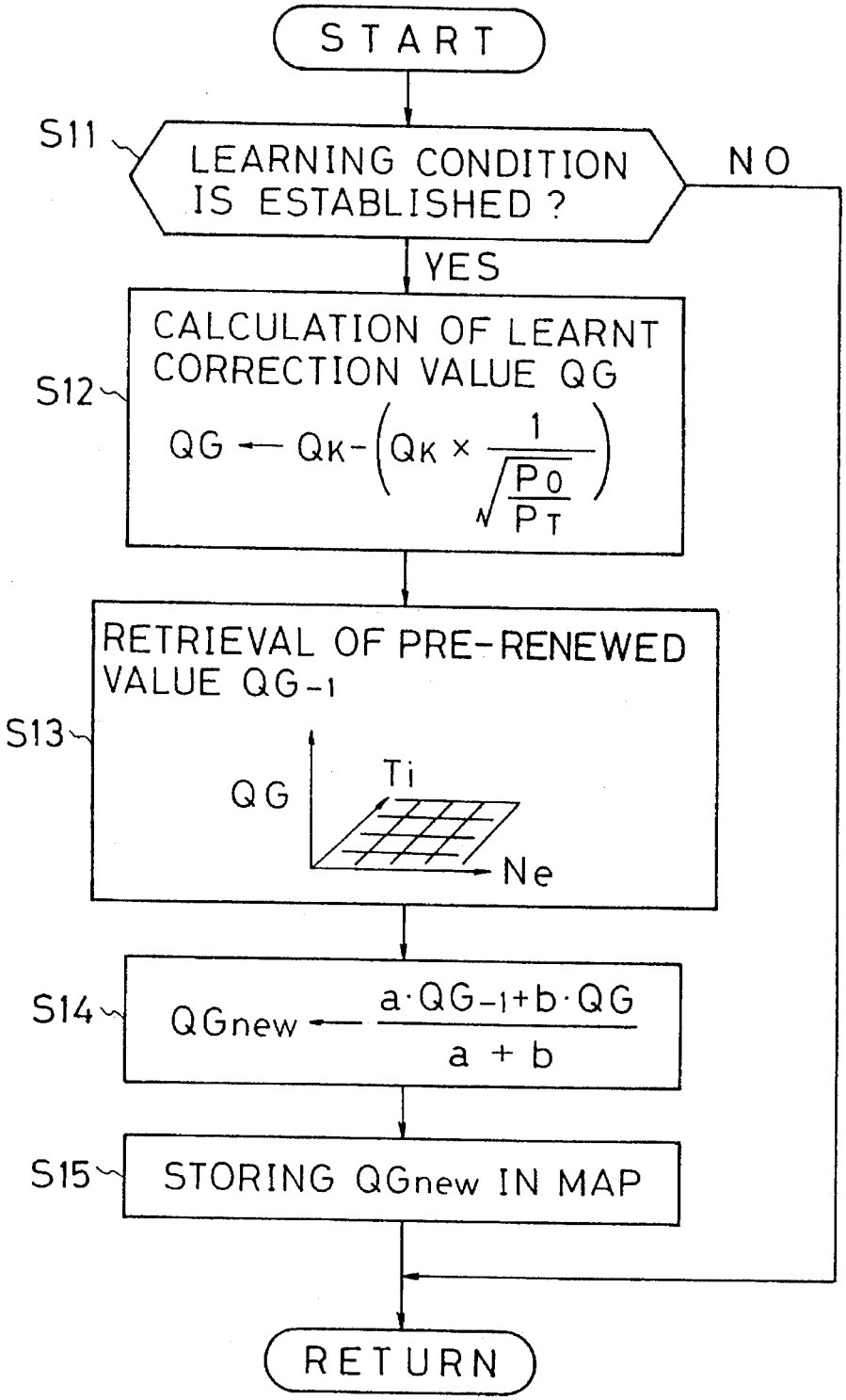
FIG. 5 is a flow chart showing how a correction value is learnt for every driving conditions in the embodiment.

In step 11 in the flow chart of FIG. 5, it is judged as to whether a learning condition is established or not. The learning condition means the steady condition in which the engine rotational speed Ne, the basic injection pulse width Tp, the fuel pressure PT and the opening degree of the throttle valve TVO are approximately constant.

When the learning condition is established, a new learnt correction amount QG is calculated in accordance with the following equation.

$$QG \leftarrow QK - QK \times 1/(Po/PT)^{1/2}$$

In the above equation, Po represents a target value for the fuel pressure in the driving condition at the present time. By the equation,excess and shortage of basic discharge QK is newly established as the learnt correction amount QG, in accordance with a ratio of the target pressure Po to an actually detected fuel pressure PT.

In step 13, by referring to a map storing learnt correction amounts QG in accordance with the injection pulse width Ti (a value equivalent to the engine load) and the engine rotational speed Ne, the learnt correction amount QG stored in the map correspondingly to the driving condition is retrieved as the pre-renewed learnt correction amount $QG_{-1}$.

Then, in step 14, a weighted mean of the learnt correction amount QG newly calculated in step 12 and the previous or pre-renewed learnt correction amount $QG_{-1}$ retrieved in step 13 is calculated, and the thus calculated weighted mean is set as a map renewal value QGnew.

In step 15, the map renewal value QGnew is reloaded in the map of the learnt correction amount QG as data corresponding to the present driving condition.

Thus, when the fuel pump 2 is controlled to drive in accordance with the basic discharge QK which is set so as to obtain the target pressure Po, the learnt correction amount QG corresponding to excess and shortage of the basic discharge QK is learnt to be set for every driving conditions based on comparison of the target pressure Po with the actual fuel pressure PT, if the target pressure Po cannot actually be obtained.

Thus, even if the discharge (fuel pressure) obtained correspondingly to the control output is different from an expected value due to the variation and/or degradation of the fuel pump 2, such a difference can be compensated to thereby ensure a desired discharge. In addition, it is possible to enhance accuracy of discharge control for the fuel pump 2 accomplished in dependence on the injection pulse width Ti and the engine rotational speed Ne, and also possible to obtain an optimum fuel pressure with high accuracy for every driving conditions without generation of excess fuel.

In the above mentioned embodiment, the basic discharge QK and the learnt correction amount QG are stored in dependence on the injection pulse width Ti and the engine rotational speed Ne. However, it should be noted that if the engine is of type having a boost sensor in place of the air flow meter 8, an intake negative pressure detected by the boost sensor may be used as a parameter corresponding to the engine load in place of the injection pulse width Ti.

INDUSTRIAL APPLICABILITY

As aforementioned, in accordance with the apparatus and method for controlling fuel supply to the engine according to the present invention, in a construction wherein fuel is force-fed to a fuel injection valve through a fuel pump, a required fuel amount can be ensured without excess fuel supply from the fuel pump. The application of the apparatus and method to an engine for an automobile ensures to avoid the temperature rise in a fuel tank due to return fuel back from the engine, thereby it is possible to provide an automobile capable of avoiding diffusion of fuel into atmosphere.

We claim:

1. An apparatus for controlling fuel supply to an engine, comprising:

a fuel injection valve for injecting fuel therethrough into an intake system of said engine;

a fuel pump for sucking thereinto fuel contained in a fuel tank and force feeding the fuel to said fuel injection valve through a fuel supply passage;

driving condition detecting means for detecting a driving condition of said engine, correlating to an amount of fuel required by said engine;

control value for steady condition setting means for setting a control value for steady condition for said fuel pump, corresponding to a steady condition, said control value for steady condition being determined using said driving condition of said engine detected by said driving condition detecting means as a parameter;

transient condition detecting means for detecting a transient condition where said amount of fuel required by said engine varies, and for detecting a variation rate of said amount of fuel required by said engine;

transient correction value setting means for setting a transient correction value for correcting said control value for steady condition based on said variation rate of said required fuel amount detected by said transient condition detecting means; and fuel pump control means for setting a final control value by correcting said control value for steady condition based on said transient correction value when the transient condition is detected by said transient condition detecting means, while setting said control value for steady condition as a final control value when a transient condition is not detected by said transient condition detecting means, and for controlling and driving said fuel pump based on a thus set final control value.

2. An apparatus for controlling fuel supply to an engine as claimed in claim 1, wherein said control value for steady condition setting means comprises:

basic control value storing means for storing in advance a basic control value for said fuel pump, said basic control value being determined using said driving condition of said engine detected by said driving condition detecting means as a parameter;

fuel pressure detecting means for detecting the pressure of fuel force-fed from said fuel pump;

correction value learning means for learning a correction value for correcting said basic control value based on comparison of the fuel pressure detected by said fuel pressure detecting means with a target pressure, and for storing thus learnt correction value for every engine driving condition detected by said driving condition detecting means; and basic control value correcting means for determining a basic control value and a correction value both corresponding to the engine driving condition detected by said driving condition detecting means by said basic control value storing means and said correction value learning means, and for setting a value obtained by correcting said basic control value based on said correction value as a final control value for steady condition.

3. An apparatus for controlling fuel supply to an engine as claimed in claim 1, wherein said driving condition detecting means detects engine load and engine rotational speed.

4. An apparatus for controlling fuel supply to an engine as claimed in claim 1, wherein said transient condition detecting means detects a variation rate of one of parameters of the pressure of fuel force-fed from said fuel pump, an amount of intake air supplied into said engine, and basic injection pulse width of said fuel injection valve, and detects a transient condition based on the detected variation rate.

5. An apparatus for controlling fuel supply to an engine as claimed in claim 2, wherein said correction value learning means learns a correction value only under the condition of steady driving condition of said engine.

6. An apparatus for controlling fuel supply to an engine as claimed in claim 2, wherein said correction value learning means calculates a new correction value based on the detected fuel pressure, the target pressure, and the basic control value stored in said basic control value storing means corresponding to the engine driving condition at the time, and reloads data using a weighted means value of the correction value stored corresponding to the engine driving condition at the time and said correction value newly calculated, as a correction value corresponding to said engine driving condition.

7. A method for controlling fuel supply to an engine having a fuel injection valve for injecting fuel therethrough into an intake system of said engine, and a fuel pump for sucking thereinto fuel contained in a fuel tank and force-feeding said fuel to said fuel injection valve through a fuel supply passage, said method comprising the steps of:

detecting an engine driving condition correlating to an amount of fuel required by said engine;

setting a control value for steady condition for said fuel pump corresponding to a steady condition, said control value for steady condition being determined using said driving condition of said engine detected in said step of detecting an engine driving condition;

detecting a transient condition where said amount of fuel required by said engine varies, and detecting a variation of said amount of fuel required by said engine;

setting a transient correction value for correcting said control value for steady condition based on said variation rate of said required fuel amount detected in said step of detecting a transient condition; and setting a final control value by correcting said control value for steady condition based on said transient correction value when a transient condition is detected in said step of detecting a transient condition, while setting said control value for steady condition as a final control value when a transient condition is not detected in said step of detecting a transient condition, and controlling and driving said fuel pump based on a thus set final control value.

8. A method for controlling fuel supply to an engine as claimed in claim 7, wherein said step of setting a control value for steady condition comprises the steps of:

storing in advance a basic control value for said fuel pump, said basic control value being determined using said driving condition of said engine detected in said step of detecting a driving condition as a parameter;

detecting the pressure of fuel force-fed from said fuel pump;

learning a correction value for correcting said basic control value based on comparison of the fuel pressure detected in said step of detecting the fuel pressure with a target pressure, and storing thus learnt correction value for every engine driving condition detected in said step of detecting a driving condition; and determining a basic control value and a correction value both corresponding to the engine driving condition detected in said step of detecting a driving condition and said step of storing a basic control value and said step of learning a correction value, and setting a value obtained by correcting said basic control value based on said correction value as a final control value for steady condition.

9. A method for controlling fuel supply to an engine as claimed in claim 7, wherein said step of detecting an engine driving condition includes detecting the engine load and the engine rotational speed.

10. A method for controlling fuel supply to an engine as claimed in claim 7, wherein said step of detecting a transient condition includes detecting a variation rate of one of parameters of the pressure of fuel force-fed from said fuel pump, an amount of intake air supplied into said engine, and basic injection pulse width of said fuel injection valve, and detecting a transient condition based on the detected variation rate.

11. A method for controlling fuel supply to an engine as claimed in claim 8, wherein said step of learning a correction value includes learning a correction value only under the condition of steady driving condition of said engine.

12. A method for controlling fuel supply to an engine as claimed in claim 8, wherein said step of learning a correction value includes calculating a new correction value based on the detected fuel pressure, the target pressure, and the basic control value stored in said basic control value storing step corresponding to the engine driving condition at the time, and reloading data using a weighted means value of the correction value stored corresponding to the engine driving condition at the time and said correction value newly calculated, as a correction value corresponding to said engine driving condition.

* * * * *